US005469180A

United States Patent [19]

Wiggenhorn

[11] Patent Number: 5,469,180

[45] Date of Patent: Nov. 21, 1995

[54] METHOD AND APPARATUS FOR TUNING A LOOP ANTENNA

[75] Inventor: James T. Wiggenhorn, Coral Springs, Fla.

[73] Assignee: Motorola, Inc., Schaumburg, Ill.

[21] Appl. No.: 236,802

[22] Filed: May 2, 1994

[51] Int. Cl.[6] ..... H01Q 11/12

[52] U.S. Cl. ..... 343/744; 343/703; 343/741; 343/742; 343/745; 343/748; 455/123

[58] Field of Search ..... 343/701, 703, 343/718, 722, 741, 742, 744, 745, 748; 455/121, 123, 125, 129; H01Q 11/12

[56] References Cited

U.S. PATENT DOCUMENTS

| | | | |
|---|---|---|---|
| Re. 18,140 | 7/1931 | Phillips | 343/701 X |
| 1,479,638 | 1/1924 | Zworykin | 343/748 X |
| 1,483,383 | 2/1924 | Sandell | 343/748 X |
| 1,997,271 | 4/1935 | Zepler | 343/748 X |
| 2,185,336 | 1/1940 | Gerardi | 343/748 X |
| 2,751,590 | 6/1956 | Troutman | 343/742 |
| 3,618,083 | 11/1971 | Burley et al. . | |
| 4,206,403 | 6/1980 | Tucker | 324/78 |
| 4,593,412 | 6/1986 | Jacob | 455/129 |
| 5,278,997 | 1/1994 | Martin | 455/127 |
| 5,296,866 | 3/1994 | Sutton | 343/701 |

OTHER PUBLICATIONS

United States Air Force, *Antenna Systems,* Jun. 1953, pp. 278–284.

QST Magazine, "You Can Build: A Compact Loop Antenna for 30 through 12 Meters", by Robert Capon, May 1994, pp. 33–36.

*Primary Examiner*—Donald Hajec
*Assistant Examiner*—Steven Wigmore
*Attorney, Agent, or Firm*—Frank M. Scutch, III

[57] ABSTRACT

A method and apparatus for rapidly determining the resonance of a loop antenna (7). In order to set the loop antenna (7) to the desired operating frequency, the antenna is used with an amplifier (15). In view of the high Q provided by the loop, it is used at the output of the amplifier (15) to create a tank circuit. The loop is adjusted to create the proper amount of phase shift driving the amplifier (15) into oscillation. The antenna is then tuned to allow the amplifier (15) to oscillate at a desired frequency. This frequency is monitored on a frequency counter. When the desired frequency is attained, the loop antenna is properly adjusted and can be connected to a transmitter. The invention allows quick and easy adjustment of the loop antenna without having to apply RF energy to the antenna or make VSWR calculations.

7 Claims, 1 Drawing Sheet

METHOD AND APPARATUS FOR TUNING A LOOP ANTENNA

TECHNICAL FIELD

This invention relates in general to antennas and particularly to loop antennas.

BACKGROUND

Loop type antenna systems have been known and utilized effectively for many years. A loop antenna has many applications due to its relatively small size and directivity. Additionally, the loop antenna has a very high Q factor and has a narrow bandwidth of approximately 15–20 KHz when used in the high frequency spectrum around 6 MHz. Unlike coaxial type devices, the loop has only one point of resonance and cannot be used with even or odd multiples of a desired operating frequency.

One problem associated with using this type antenna is matching the antenna to the transmitter for which it is to be used. The high Q factor allows the antenna to be tuned only to one very sharp and selective frequency. The typical method of tuning this and other types of antennas to resonance is to continually adjust the dimensions of the antenna as well as its associated matching network while checking the voltage standing wave ratio (VSWR) along the feed line. The VSWR is generally calculated by measuring the power radiated by the transmitter as well as the power which is reflected due to antenna impedance mismatch. The ratio or percentage the forward power to reflected power is the VSWR. Ideally, an VSWR of 1:1 would offer the best performance where the antenna is perfectly matched to the transmitter and no radiated power is reflected back through the feed line. Thus, to achieve the lowest VSWR possible it was necessary to continually adjusting the antenna while measuring the VSWR. This quickly turns into a cumbersome ordeal particularly when the antenna is located some distance from the VSWR measurement point and where only one person is involved.

SUMMARY OF THE INVENTION

Briefly, according to the invention, there is provided an apparatus and method of tuning a loop antenna structure. The invention utilizes an amplifier circuit which may be adjusted to oscillate at a desired transmitter operating frequency.

DETAILED DESCRIPTION OF THE PREFERRED EMBODIMENT

Figure 1:
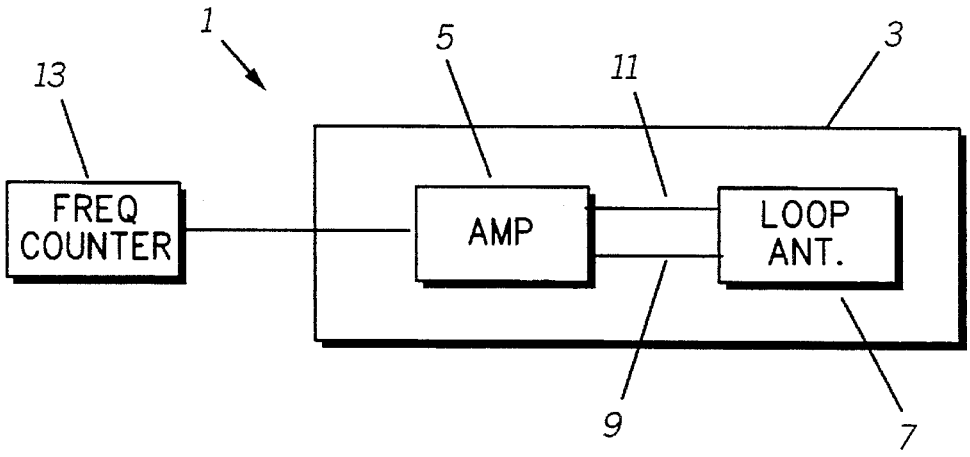
FIG. 1 is a bloc/diagram showing the configuration of the invention.

Referring now to FIG. 1, a block diagram depicting the elements of the present invention are generally shown at 1. An oscillator 3 includes an amplifier circuit 5 attached to a loop antenna 7. Due to the high Q and sharp resonance frequency of the loop antenna 7, the antenna is positioned to replace the output tank circuit of the amplifier circuit 5. Loop antenna 7 is attached to the amplifier circuit 5 through connecting lines 9 and 11 which create a feedback loop. Hence, the loop antenna 7 is analogous to a quartz crystal or other resonant tank circuit in an oscillator where the frequency of the oscillator is determined by the resonant frequency of loop antenna 7. Loop antenna 7 forms a high Q resonant structure with a Q factor greater than or equal to 400. Accordingly, amplifier circuit 5 is essentially an oscillator without an external tank circuit. When a device which provides a high Q such as the loop antenna is attached to the output of the amplifier circuit 5 providing the proper phase shift—oscillation will occur. In order to easily determine the operating frequency of amplifier circuit 5, a frequency counter 13 is attached to the amplifier circuit to quickly and accurately measure the oscillating frequency.

Figure 2:
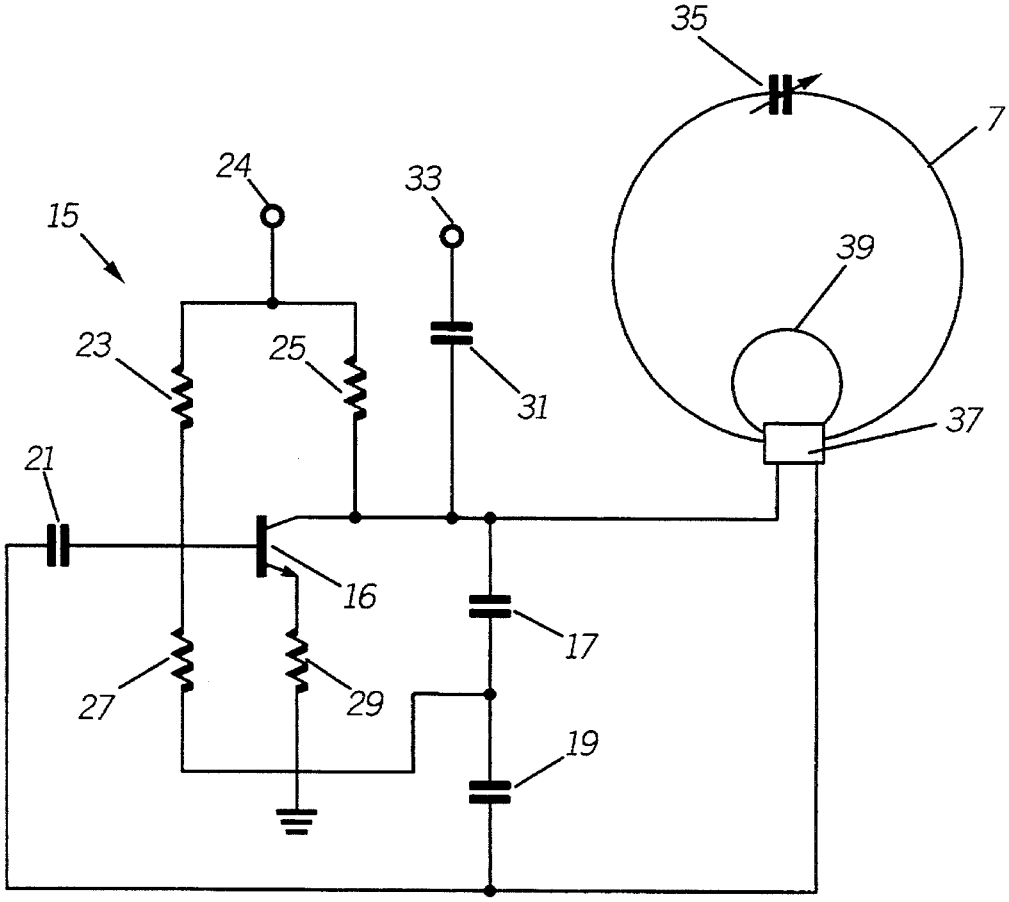
FIG. 2 is a schematic showing an oscillator circuit and frequency counter used with the loop antenna.

FIG. 2 shows a schematic representation of the amplifier circuit 5, attachment points for the loop antenna 7 and frequency counter 13. In the schematic, a "clapp" oscillator is shown generally at 15. A clapp oscillator includes a single transistor 16 and was selected for the convenience of establishing the ratio of feedback through capacitors 17 and 19. This configuration allows the oscillator to be dependent on the resonance of the loop antenna 7. Capacitors 17 and 19 determine the amount of feedback necessary to sustain oscillation. Utilizing this type of oscillator allows for the high Q circuit, i.e. the loop antenna 7, to be placed external to the oscillator rather than fight at the base or collector of transistor 16. Although the clapp oscillator is shown here it should be recognized by those skilled in the art that any type of oscillator could be used which would accomplish the same result.

Oscillator 15 further includes capacitor 21 used to block DC and provide a feedback voltage back to the base of transistor 16. A supply voltage is applied to terminal 24 while resistors 23, 25, 27 and 29 are used for biasing. Oscillator 15 is generally biased as a class A amplifier stage. The resistor values optimally would be selected at low enough value to establish substantial gain yet high enough value to obtain stability. Capacitor 31 is used to couple an external frequency counter (not shown) to an output terminal 33.

Loop antenna 7 is a planar high Q resonator consisting of at least a single circular loop structure. When operating in the high frequency spectrum the loop is generally at least I meter in diameter and may be broken or segmented in order to insert matching devices. The matching devices take the form of a tuning capacitor such as capacitor 35 and a matching transformer 37 for matching loop antenna 7 to a transmission feed line. Tuning capacitor 35 may be a large air variable or vacuum variable type device depending on power requirements and has a value ranging from 10–300 pF. The matching network can also vary in configuration. These can range from a simple asymmetrical tap (not shown) from the transmission feed line forming a gamma-style match to transformer or balun which matches the feed line to loop antenna 7 using a secondary matching loop 39. The proper selection of sizes between loop antenna 7 and the secondary matching loop 39 determines a ratio used to match the transmission feed line.

When using the invention, it is easy to preset loop antenna 7 to a desired resonant frequency before any transmission occurs with little effort an at little expense. This is accomplish by attaching oscillator 15 to a loop antenna 7. A frequency counter is also connected to output terminal 33. While observing the frequency counter capacitor 35 is adjust to a point where oscillator 15 resonates at the desired frequency. Afterward, loop antenna is disconnected from oscillator 15 and connected directly to a transmitter or transmitter feed line. Thus, no VSWR measurements were needed to adjust the antenna resonance allowing for a simple and easy method of adjusting the antenna before transmitting.

In summary the invention is directed to an apparatus and method of tuning a loop antenna structure. The invention utilizes an amplifier circuit which may be adjusted to oscillate at a desired transmitter operating frequency. In order to easily tune the loop antenna to a proper resonant frequency of operation, the antenna is temporarily integrated into the amplifier circuit. Thus, the loop antenna acts as the output tank circuit of the amplifier circuit when driven into oscillation. A standard frequency counter may then attached to the amplifier circuit while the antenna is adjusted. When the frequency counter indicates that the amplifier circuit is operating at the desired transmitter operating frequency, resonance of the antenna has been achieved. The antenna can then be disconnected from the amplifier circuit where it can be attached to the output of a transmitter. The transmitter may then be used with the knowledge that the antenna has been adjusted for proper frequency. The apparatus is easy to use and avoids the burdensome process of continually adjusting the antenna in incremental stages to achieve a low VSWR.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as ;defined by the appended claims.

What is claimed is:

1. An apparatus for tuning the frequency of a loop antenna to a selected operating frequency comprising:

an amplifier attached to the loop antenna, the loop antenna being adjustable for providing a predetermined degree of phase shift allowing the amplifier to achieve oscillation at an oscillating frequency; and a frequency counter attached to the amplifier for monitoring the oscillating frequency of the amplifier to determine when the loop antenna is correctly adjusted through the amplifier's oscillation at the selected operating frequency.

2. An apparatus according to claim 1 wherein said amplifier is configured as a clapp oscillator.

3. An apparatus according to claim 1 wherein said amplifier is biased as a class A amplifier.

4. An apparatus according to claim 1 wherein the loop antenna has a substantially high Q factor and is tuned using a variable reactive element.

5. An apparatus according to claim 4 wherein the variable reactive element is a capacitor which is connected in series within the loop antenna.

6. A method of rapidly setting the resonance of a loop antenna to a desired operating frequency comprising the steps of:

applying the output of an amplifier to a loop antenna;

adjusting the loop antenna to provide a predetermined degree of phase shift to the amplifier;

allowing the amplifier to oscillate due to the predetermined degree of phase shift provided by the loop antenna; and setting the oscillating frequency of the amplifier using a frequency counter attached to the amplifier by the adjusting phase shift provided by the loop antenna so the amplifier attains the desired operating frequency.

7. A method according to claim 6 further including the steps of removing the loop antenna from the amplifier after the loop antenna has been adjusted to resonate at the desired operating frequency; and connecting said antenna to a radio transmitter.

* * * * *